US005384510A

United States Patent [19]

Arnold

[11] Patent Number: 5,384,510

[45] Date of Patent: Jan. 24, 1995

[54] INCANDESCENT LAMP WITH AN IMPROVED FILAMENT IMPLEMENTATION

[76] Inventor: Bruce H. Arnold, 2023 Ripley Ave., Redondo Bch, Calif. 90278-5046

[21] Appl. No.: 908,071

[22] Filed: Jul. 6, 1992

[51] Int. Cl.[6] ..... H01K 1/18

[52] U.S. Cl. ..... 313/316; 313/272; 313/279; 313/578

[58] Field of Search ..... 313/578, 580, 272, 273, 313/279, 292, 316, 569

[56] References Cited

U.S. PATENT DOCUMENTS

| | | | |
|---|---|---|---|
| 3,227,920 | 1/1966 | Peek, Jr. et al. | 313/316 X |
| 3,654,512 | 4/1972 | Spiteri | 313/316 X |
| 3,886,400 | 5/1975 | Dill | 313/316 X |
| 3,983,447 | 9/1976 | Mark et al. | 313/316 X |
| 4,703,220 | 10/1987 | Walsh | 313/112 |
| 4,782,429 | 11/1988 | Walton et al. | 313/316 X |
| 4,841,196 | 6/1989 | Waymouth | 313/316 X |
| 4,935,662 | 6/1990 | Kachenmeister, Jr. | 313/279 |
| 5,187,405 | 2/1993 | Rachel et al. | 313/316 |

*Primary Examiner*—Donald J. Yusko
*Assistant Examiner*—Ashok Patel

[57] ABSTRACT

An incandescent lamp having a plurality of filaments which can effectively negate disadvantages of unpredictable operation and complete darkness after failure when operated similar to a conventional single filament lamp. In a preferred embodiment of the invention two filaments enclosed within an a suitable envelope are electrically connected to incandesce simultaneously. The embodiment having two filaments enclosed within an envelope of the lamp has three states: one, both filaments energize simultaneously and the lamp radiates maximum visible energy; two, first filament fails but the second filament remains energized and the lamp radiates relatively less visible energy; and three, second filament fails and the lamp is completely dark. In state one, the lamp operates similar to a conventional single filament lamp. In state two, the lamp is radiating less visible energy indicating to the user the need to be replaced before occurrence of state three, complete failure of the lamp. The lamp in state two sufficiently illuminates the area in question with an amount of visible light energy that is still considered safe. In summary, the preferred embodiment warns the user to replace the lamp before complete failure, effectively negating disadvantages of a conventional single filament lamp.

1 Claim, 3 Drawing Sheets

INCANDESCENT LAMP WITH AN IMPROVED FILAMENT IMPLEMENTATION

RELATED PATENT APPLICATIONS

U.S. Pat. No. 4,703,220 dated Oct. 27, 1987, issued to Peter J. Walsh. U.S. Pat. No. 4,935,662 dated Jun. 19, 1990, issued to Carl F. Kachenmeister, et al.

BACKGROUND OF THE INVENTION

This invention relates to incandescent lamps and, more particularly, to an improved filament implementation wherein a plurality of filaments is utilized within the incandescent lamp.

In a single filament incandescent lamp, an incandescent filament is enclosed within a visible light transmitting envelope. During the lamp's use, the filament is exposed to physical, operational and environmental conditions which cause the filament to stress at points or areas along its length. As a result of these points or areas being stressed the filament eventually breaks, the lamp fails and, subsequently, is completely dark.

Disadvantages result from the aforementioned unpredictable filament breakage, and completely dark and failed lamp. A particular situation of interest involves the safety and well-being of people. Representative examples demonstrating the possible consequences of lamp performance limitations due to the foregoing disadvantages include:

- A landlord may be held liable to tenants, while they are on the property, if injury or loss results from a fall or an assault caused by insufficient lighting due to a failed lamp;
- Late at night, upon returning home, a person discovers that an inside or outside light has failed. This light was supposed to provide basic security by discouraging any would-be burglars, vandals and any other undesirable encounters;
- A person in the basement has to negotiate a potentially dangerous trip back up the stairs in darkness because of a failed lamp;
- Elderly and/or disabled people, unable to replace a failed lamp, have to risk potential severe consequences moving about in darkness until an aid replaces the lamp;
- A failed exit light could prevent people from locating an emergency exit and evacuating the premises.

It will be appreciated that another attribute of the invention that is of particular interest, is contribution to reduction of economic hardship. The foregoing disadvantages of the single filament lamp could also contribute to economic disaster, as demonstrated by the following illustrative examples:

- Warning lights above studio and darkroom doors are inoperative due to failed lamps;
- Warning lights on instrument, control or indicator panels that are inoperative, due to a failed lamp, can lead to catastrophic loss.

Prior to this invention no incandescent lamp with a self contained reduced-light level filament failure warning has been available.

Prior to this invention no incandescent lamp that can be operated as a single light-level lamp with a self contained reduced-light level filament failure warning, or as a multi-light level lamp has been available.

SUMMARY OF THE INVENTION

It is an object of the invention to provide an incandescent lamp which contributes to reduction of injury, loss and liability, due to a failed lamp, through its use.

It is another object to provide an incandescent lamp having a self-contained filament failure warning feature.

It is still another object to provide an incandescent lamp having a greater life expectancy than a single filament lamp for a given lamp wattage.

It is still further an object to provide an incandescent lamp being easy for the user to implement.

It is yet another object to provide an incandescent lamp which contributes to reduction of economic hardship, due to a failed lamp, through its use.

It is yet another object to provide an incandescent lamp that can be easily converted from use as a filament failure warning lamp into a multi-light level lamp to reduce required inventory.

It is yet another object to provide an incandescent lamp, comprising any, or all, of the above-mentioned objects, which is easy and inexpensive to manufacture and assemble.

It is yet another object of the invention to contribute to more economic inventory requirements in that the invention lamp is operable either as a single light level lamp or as a multi-light level lamp obviating the need to stock two different lamps.

The foregoing objects, among others, are achieved in accordance with the present invention by means which indicate the necessity or requirement to replace the lamp before complete failure and which allow for conversion to a multi-light level lamp. The means is a plurality of filaments implemented by connective means. The connective means allow the plurality of filaments to be either simultaneously or singularly energized and heated to design incandescence as in a conventional incandescent lamp. The plurality of filaments radiate energy in both the visible and infrared portions of the spectrum. Thus, unlike the single filament conventional lamp having only the two states of functioning and failed, the present invention has multiple states greater than two. The invention is easy to implement, similar to the conventional single filament lamp, by simply inserting the invention lamp into its conventional and complementary lamp socket. The methods and material used for manufacture and assembly of the invention lamp are those for the conventional lamp.

By way of example and in accordance with the invention, two incandescent filaments are enclosed within a visible light transmitting envelope of the lamp. In the first usage the two filaments are energized and incandesce simultaneously due to the implementation of a connective means. In this example, the lamp has three states. During the span of state one both filaments are energized and incandescing; during the span of state two one filament has failed, but the other filament remains energized and incandescing; in the third state, the second, and last, filament fails and the lamp is completely dark. In the foregoing first state, since both filaments are energized and incandescing, the lamp radiates maximum visible energy. However, in the foregoing second state, since the first filament has failed while the second filament is still energized and functioning, the lamp radiates relatively less visible energy. The result is a noticeably dimmer lamp providing warning, or indicating, to the user the need to replace the lamp before complete failure. Hence, before complete failure there exists a warning and opportunity for the lamp to be replaced, while it is still illuminating the area in questioned at a relatively lower light level.

It is recognized that a broken filament may come into contact with an adjacent incandescing filament. The resulting shorting contact could cause failure of the functioning incandescing filament thus eliminating the foregoing warning feature of the present invention.

In accordance with an important feature of the invention, the occurrence of the aforementioned shorting contact may be reduced or eliminated by positioning or orientating the filaments in the lamp so as to provide physical separation between the broken filament's distal ends and any part of the remaining incandescing filaments. If the aforementioned positioning is not possible, at least one restraint means may be employed. This restraint means with the appropriately positioned filaments prevents the aforementioned shorting contact from occurring. The restraint means allows for the internal components of the lamp to be placed closer together than the aforementioned positioning without the restraint means. The restraint means may circumscribe or surround the filament's axis and may touch, grasp, or avoid the filament. Therefore, the restraint means acts as a barrier. Unlike prior art, the restraint means has a dual function. The first function of the restraint means, similar to prior art, is to extend the life of the filament the restraint means is acting upon. Examples of the restraint means demonstrating the foregoing first function are shown in U.S. Pat. No. 4,935,662 and in conventional incandescent light bulbs. The second function of the restraint means, unlike prior art, is to prevent a broken filament from coming into contact with any incandescing filament(s), thus protecting any adjacent functioning filament. In summary, the present invention's restraint means extends the life of adjacent filaments and the filament the restraint means is acting on, while the prior art extends only the life of the filament the restraint means is acting upon and not any adjacent filaments.

Typical filaments used in conventional incandescent lamps demonstrate general relationships and properties. Electrical, mechanical and physical characteristics of the filaments derived from the foregoing relationships and properties may be used for optimizing the function of the present invention. The electrical characteristics of the filaments necessitate a compromise between the filament's parameters and the lamp's performance, and therefore, the foregoing characteristics must be weighted in order of importance. As a result of implementing desired electrical characteristics, the lamp can be designed to have a greater life expectancy than a single filament lamp for a given lamp wattage, contributing to its factor of safety. Also as a result of implementing desired electrical characteristics, the lamp can have a failure warning feature indicating that the replacement of the lamp is necessary before complete failure; thus, reducing the users' exposure to possible economic mishap and injury.

The foregoing connective means can be constructed so as to allow both filaments to be simultaneously energized or individually energized. When both filaments are simultaneously energized the lamp functions identically to the foregoing first usage. When both filaments are allowed to individually incandesce, the second usage, the lamp functions as a conventional multi-light level lamp. The consumer chooses how the lamp will be used by simple manipulation of the connective means.

DETAILED DESCRIPTION

For a better understanding of the present invention, together with other and further objects, advantages, features, and capabilities thereof, reference is made to the following disclosure and appended claims taken in conjunction with the above-described drawings.

The undesirable operational characteristics, e.g., unpredictable operation and complete darkness after failure, of a single filament bulb may be effectively eliminated by using a plurality of filaments in conjunction with a connective means.

Figure 1A:
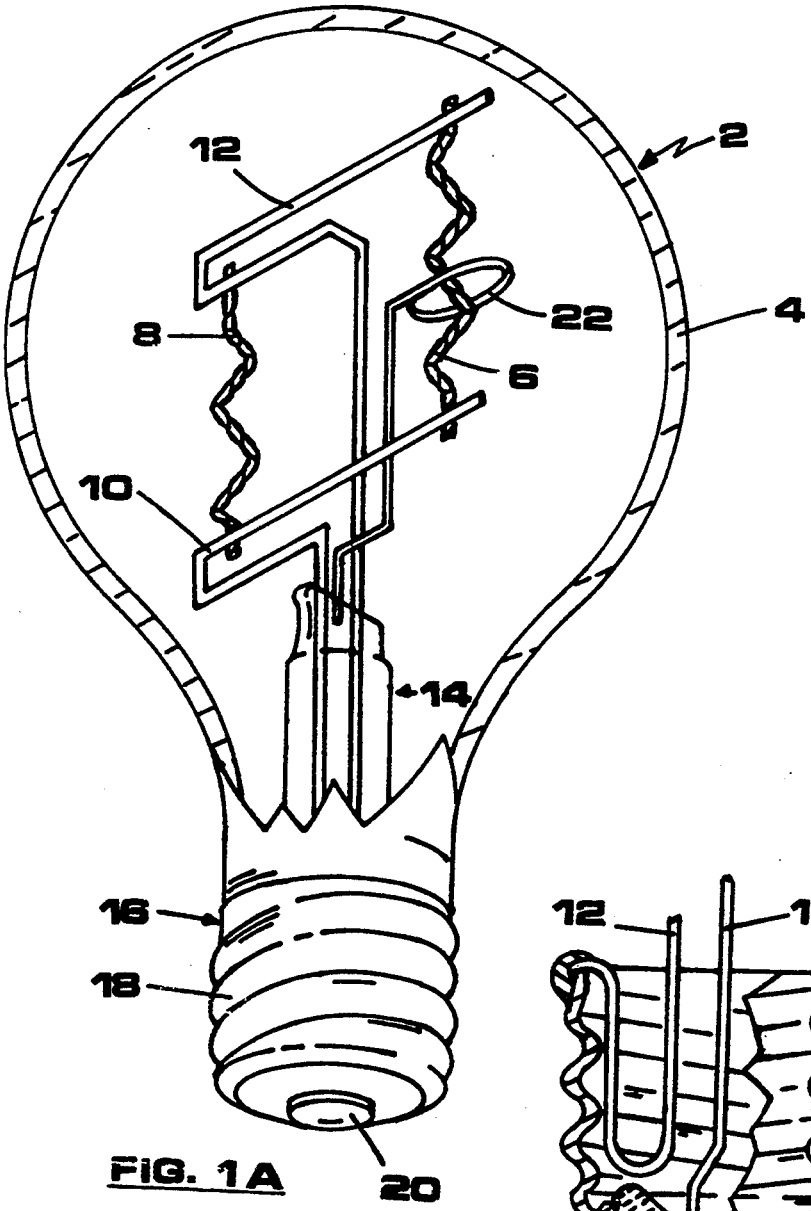
FIG. 1*a* is a perspective view, partially in cross section, of a first embodiment of the invention showing two filaments, filament restraint means and the connective means all enclosed within the visible light transmitting envelope of the lamp in accordance with the invention.
Figure 1B:
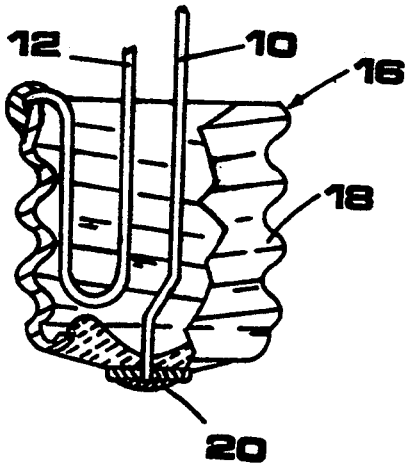
FIG. 1*b* is an elevation sectional view of a conventional incandescent lamp base partially in cross section, utilized as the base for the first embodiment of the invention.

With reference to FIG. 1*a*, there is shown a first lamp assembly (2) which is constructed in accordance with the first embodiment of the invention and includes a hermetically sealed envelope (4) of lime glass or other suitable visible light transmissive material. A first filament (6) and the second filament (8) are located within the envelope (4). The filaments (6 and 8) are elongated, and may be made of tungsten, doped tungsten, or other suitable material that properly incandesces at design condition. The shape of the filaments (6 and 8) may be single-, double-, or tripled-coiled or other suitable configuration that properly incandesces at design condition. The ends of the filaments (6 and 8) are both connected at one end to lead (10) and at the other end to common lead (12). The leads (10 and 12) are supported by a reentrant stem (14) which is a continuation of the envelope (4). As shown in FIG. 1*b*, common lead (12) is connected to a threaded ferrule (18), and lead (10) is connected to a button contact (20). Said threaded ferrule (18) and button contact (20), comprising a conventional base (16), permits connection to a conventional power source (not shown).

Figure 1C:
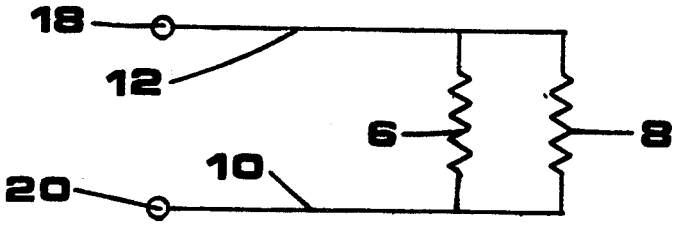
FIG. 1*c* is an electrical schematic of the first embodiment.

In FIG. 1*a*, the connecting means, comprising connecting leads (10 and 12), dictate that both filaments (6 and 8) incandesce simultaneously. FIG. 1*c*, the equivalent electrical schematic for the first embodiment, shows said filaments (6 and 8) are electrically in parallel and have the same input voltage simultaneously applied across them by connecting leads (10 and 12). Hence, when the input voltage from a conventional design power source (not shown) is applied across the threaded ferrule (18) and the button contact (20), comprising the conventional base (16), said input voltage is simultaneously applied across the filaments (6 and 8) through said connecting leads (10 and 12).

Because the distal ends of a broken filament may come into contact with an adjacent and still incandescing filament and cause failure of the lamp, the filaments may be orientated so as to prevent the foregoing contact (not referenced in the drawing). This orientation may be obtained by spatially separating the filaments so as to prevent the distal ends of the broken filament from contacting any incandescing filaments. As an alternative to the aforementioned spatial positioning a restraint means may be implemented. In FIG. 1*a*, said restraint means comprises retainer (22) which is supported by reentrant stem (14). Said retainer (22), in accordance with the invention, may be singly or multiply employed on a filament and, if desired, may be implemented on one or more filaments. Restraint means may surround but not touch said filament (FIG. 1*a*) capturing and containing the longer broken section of said filament; or it may grasp said filament (not shown) restraining the longer broken section of said filament. Therefore, the restraint means acts as a barrier separating adjacent filaments. Filament spatial separation requirements are reduced when the retainer (22) is used since the movement of longer broken section of filament is prohibited by said retainer (22).

At the beginning of lamp's life both filaments are energized and the lamp radiates maximum total visible light energy. Eventually, one filament fails while the other filament continues to radiate light resulting in relatively less total radiated light energy. Less radiated light energy is a warning to the user to replace the lamp before the invention lamp fails and is completely dark. Hence, because the lamp is illuminating the area in questioned at a relatively lower light level, there exists a warning and opportunity for the lamp to be replaced before complete failure of the lamp. Electrical characteristics of the filaments may be chosen resulting in two filaments having significantly different average life spans, and thus, greatly increasing the likelihood of the foregoing three states responsible for the warning feature of the invention lamp.

There exist general relationships and properties of filaments used in incandescent lamps which may be used for choosing the foregoing electrical characteristics of the filaments. Affecting the aforementioned general relationships and properties of incandescent filaments are filament material, length, diameter, form, coil spacing, mandrel size, lead-in wires, number of filament supports, method of mounting filament, inrush current and under voltaging. The relative inrush currents between the two filaments may be taken into account when designing or estimating the average life span of the filaments. Under voltaging, which is designing the filament for use at a higher voltage than the actual operating voltage, may be implemented on one of the filaments resulting in the two filaments having different average life spans. Aforementioned general relationships and properties of incandescent filaments are known by themselves and the best method may be employed for the particular use of the invention lamp.

Typically, as demonstrated in filaments found in conventional single filament lamps, the lower the wattage of the filament the longer the average life span of the filament. To design the invention lamp to have a life expectancy greater than a single filament lamp for a given lamp wattage, the two filaments may have approximately equal wattage ratings allowing both filaments to have minimum wattage rating. Since the individual wattages of the filaments of the invention lamp are lower than the wattage of the single filament conventional lamp, the invention lamp's average life span is greater.

Figure 2A:
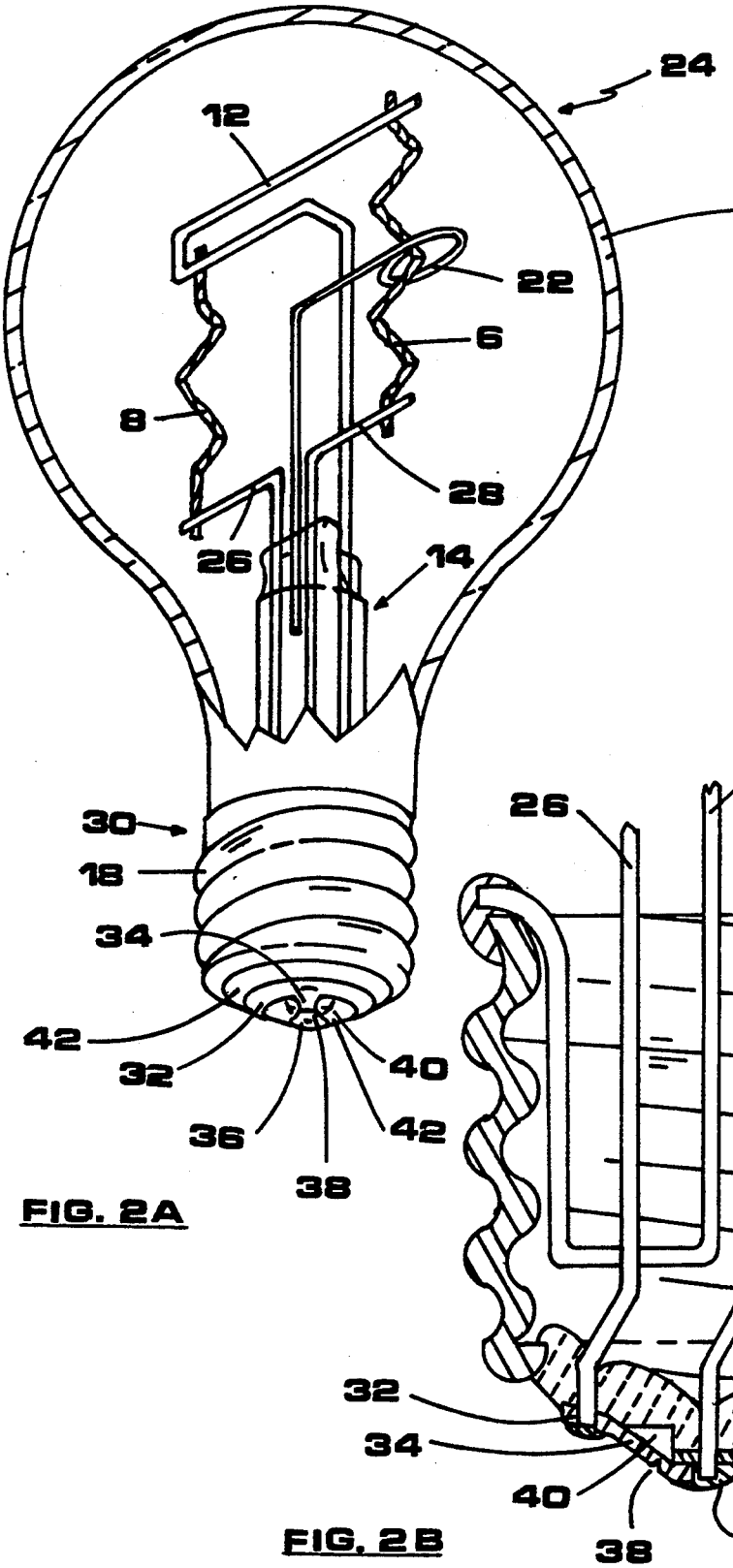
FIG. 2*a* is a perspective view, partially in cross section, of a second embodiment of the invention lamp showing two filaments enclosed within a visible light transmitting envelope and the connective means in accordance with the invention.
Figure 2B:
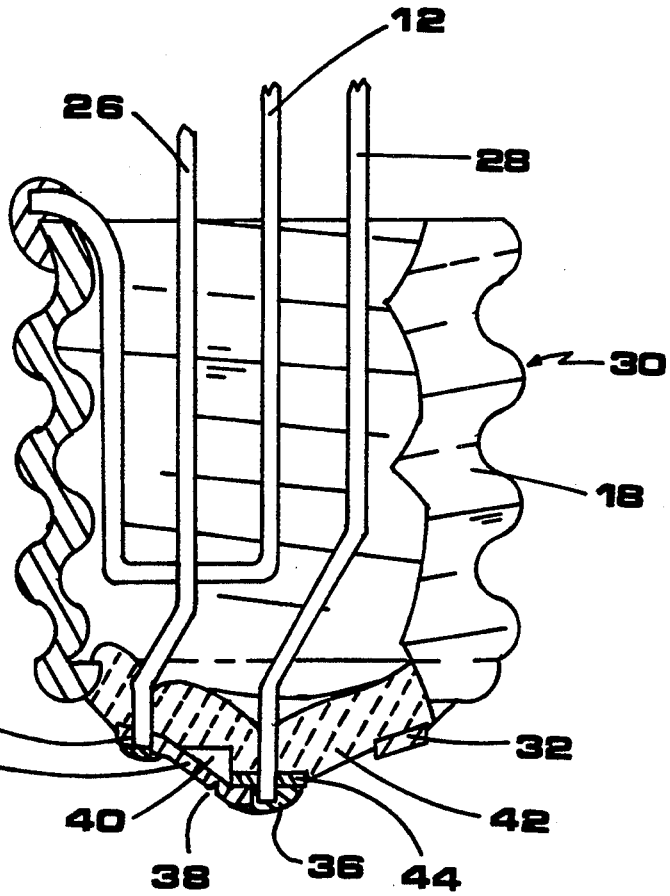
FIG. 2*b* is an elevation sectional view, partially in cross section, of the base for the second embodiment of the invention.
Figure 2C:
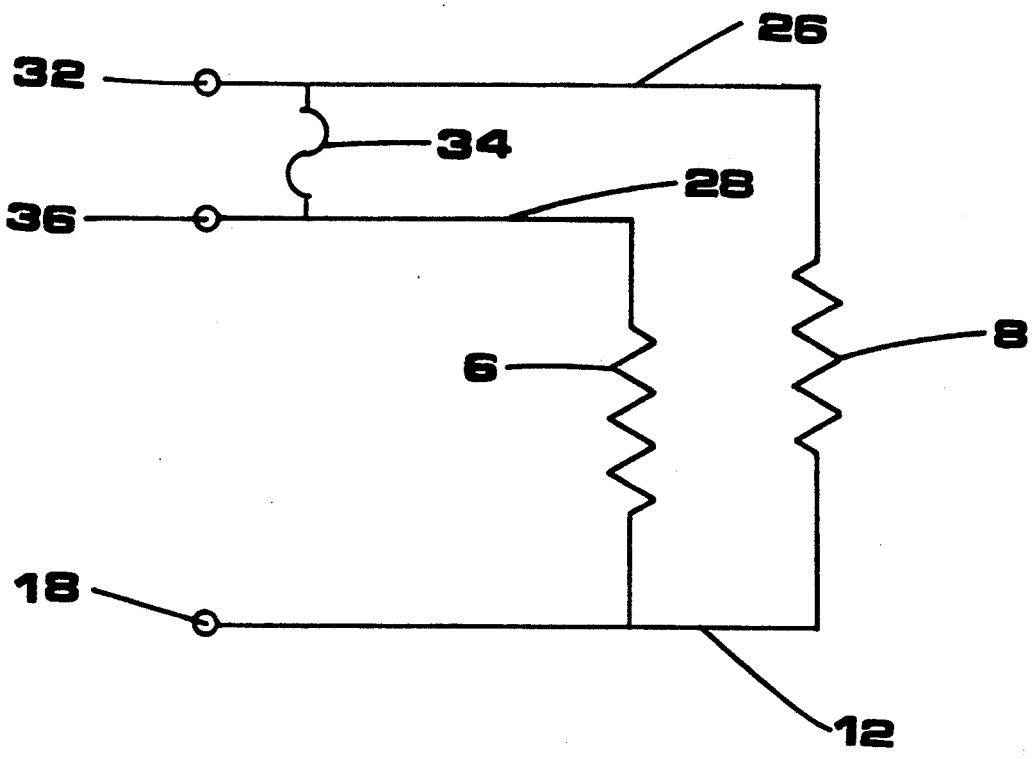
FIG. 2*c* is an electrical schematic of the second embodiment.

With reference to FIG. 2*a*, there is shown a second lamp assembly (24) which is constructed in accordance with the second embodiment of the invention and includes an envelope (4) of suitable conventional visible light transmitting material. The first filament (6) and the second filament (8) are located within the envelope (4). The filaments (6 and 8) are the same as in the first embodiment. The shape of the filaments (6 and 8) may be single-, double-, or triple-coiled or other suitable configuration that properly incandesces at design condition. The ends of filaments (6 and 8) are connected to first and second individual leads (26 and 28) on one end, and to common lead (12) on the other end; all of which are supported by reentrant stem (14), which is a continuation of the envelope (4). As shown in FIG. 2*b*, common lead (12) is connected to the threaded ferrule (18), and first individual lead (26) is connected to first individual contact (32), and second individual lead (28) is connected to second individual contact (36). The threaded ferrule (18), the short (34), and the individual contacts (32 and 36), comprising the modified conventional multi-light level base (30), permits parallel connection of filaments (6 and 8), as shown in FIG. 1*c*, to a conventional input power source (not shown). The threaded ferrule (18) functions in the same manner as described in the first embodiment.

With reference to FIGS. 2*a* and 2*b*, the conventional multi-light level base is modified by elongating a portion of the first individual contact (32) forming the short (34) which is connected at its distal end to second individual contact (36). The short (34) has deep scoring (38). A further modification made to the conventional multi-way base is the formation of a void (40) in the insulating material (42).

The sub-individual contact (44) may be employed to enhance the structural integrity of second individual contact (36) depending upon the material and manufacturing method used for second individual contact (36). If employed, the sub-individual contact (44) is positioned while the base is being formed with the insulating material (42).

The deep score (38) in the short (34) and the void (40) allow the short (34) to break when pressure, directed inward towards the base, is applied to the short (34). The short (34) is designed so that accidental electrical shorting of the power supply is not possible, that it is easy to manufacture and that it is easy to use.

Alternatively, said short (34) may be implemented with a small independent piece of electrically conductive material (not shown). The short's distal ends may be connected to first and second individual contacts (32 and 36) at the point of penetration of the first and second individual leads (26 and 28) into the first and second individual contacts (32 and 36), respectively. The short (34) may range from a thick conductive material that has been deeply scored to a conductive foil. The stipulation being that short (34) be easily broken on purpose but with resistance to accidental breakage.

The retainer (22) functions in the same manner as described in the first embodiment.

In FIGS. 2*a* and 2*b*, the connecting means comprises common lead (12), first and second individual leads (26 and 28), first and second individual contacts (32 and 36), and short (34) which dictate that both first and second filaments (6 and 8) incandesce simultaneously. Said filaments (6 and 8) are electrically in parallel and function in the same manner as that described in the first embodiment. After purchasing the invention lamp, the consumer can break the connection between the first and second contacts (32 and 36) by applying adequate pressure with one's finger, or other suitable implement, on the short (34). After the short (34) has been broken the first and second filaments (6 and 8) can be incandesced independently and the lamp operates as a conventional multi-light level lamp. The second embodiment has the advantage or ability of operation in two different capacities. First, it can operate as described in the first embodiment with a conventional power source and complementary socket designed for conventional single filament bulbs; second, it can be operated as a conventional multi-light level lamp with a conventional power source and complementary socket designed for a conventional multi-light level bulb.

To implement the invention, the consumer simply replaces an existing lamp with the invention lamp. Because of the failure warning feature of the first lamp embodiment, the lamp contributes to reduction of injury, economic hardship and other liability, due to a failed lamp. Because of the breakaway feature of the shorting contact in the second embodiment, the lamp can be operated either as a failure warning lamp, with the shorting contact intact, or as a conventional multi-light level lamp, with the shorting contact opened.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. An incandescent lamp comprising:

an envelope;

a reentrant stem attached to, and surrounded by, a lamp base;

at least two parallel incandescent filaments within said envelope;

connective means for electrically energizing said filaments simultaneously within said envelope; and at least one restraining means for restraining one of said filaments, said restraining means comprising a first straight section substantially perpendicular to the filaments and supported by the reentrant stem, and a second hollow circular section attached to said first section and having its diameter substantially larger than that of said one of the filaments so as to surround and not physically touch said one filament, said restraining means being electrically not connected to said connective means.

* * * * *